US008342505B2

(12) United States Patent
DeFigueiredo et al.

(10) Patent No.: US 8,342,505 B2
(45) Date of Patent: Jan. 1, 2013

(54) BOTTOM PLACEMENT SHEET ACCUMULATOR DEVICE AND METHOD FOR AN INSERTER SYSTEM

(75) Inventors: Carlos L. DeFigueiredo, Sandy Hook, CT (US); Thomas P. Nash, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 1399 days.

(21) Appl. No.: 11/583,415

(22) Filed: Oct. 18, 2006

(65) Prior Publication Data

US 2008/0093794 A1 Apr. 24, 2008

(51) Int. Cl.
*B65H 5/26* (2006.01)
*B65H 39/02* (2006.01)

(52) U.S. Cl. ..... 271/9.13; 270/52.21

(58) Field of Classification Search ..... 270/52.14, 270/52.16, 52.19, 52.21, 52.22, 58.26, 58.23; 271/212, 9.13
See application file for complete search history.

(56) References Cited

U.S. PATENT DOCUMENTS 2,427,839 A * 9/1947 Davidson ..... 270/58.29
4,826,148 A * 5/1989 Coons, Jr. ..... 271/245
5,178,379 A 1/1993 Edwards et al.
5,273,265 A * 12/1993 Edwards ..... 270/59
5,655,761 A * 8/1997 Sanchez ..... 271/4.09
5,876,029 A * 3/1999 Wright et al. ..... 271/3.18
6,203,006 B1 * 3/2001 Semanick et al. ..... 271/213
6,634,852 B2 * 10/2003 Bakoledis ..... 414/789
7,232,122 B2 * 6/2007 Mayer et al. ..... 271/4.01
2005/0017438 A1 * 1/2005 Wright et al. ..... 271/207
2006/0261542 A1 * 11/2006 Collings ..... 271/265.04

* cited by examiner

*Primary Examiner* — Patrick Cicchino
(74) *Attorney, Agent, or Firm* — Michael J. Cummings; Charles R. Malandra, Jr; Steven J. Shapiro

(57) ABSTRACT

An improved apparatus and method for accumulating sheets having a horizontal transport deck. Inserts are fed from an insert feeder positioned above the deck. Driven accumulator nip rollers are positioned to receive accumulations of sheets transported on the horizontal deck, and they are also positioned close enough to the insert feeder to receive inserts fed from the insert feeder. A recessed accumulation deck is positioned immediately downstream of the accumulator nip rollers. When a first sheet rests in the recessed accumulation deck, a subsequent second sheet will be placed on top of the first sheet when it enters the recessed deck. The process is controlled whereby insert sheets are released by the insert feeder prior to arrival of an accumulation on the deck. The released insert is driven by the accumulator nip rollers onto the recessed accumulator deck. Then when the accumulation arrives, it is deposited on top of the insert resting there.

9 Claims, 3 Drawing Sheets

BOTTOM PLACEMENT SHEET ACCUMULATOR DEVICE AND METHOD FOR AN INSERTER SYSTEM

TECHNICAL FIELD

The present invention relates to a device for sequencing sheets to be processed in an inserter system.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor (or chassis). The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Enclosures for the collations are typically fed from feeders that are positioned above the conveyor. These enclosures are fed on top of sheets that are transported below to form the desired accumulations.

SUMMARY OF THE INVENTION

For information to be properly organized in an envelope, it is sometimes desirable to have an insert positioned at the bottom of an accumulation, instead of the top. This application describes an improved apparatus and method to accumulate sheets when an insert, fed from an overhead feeder, needs to be placed at a bottom portion of the accumulation. The accumulator apparatus includes a transport chassis that includes pusher fingers to push accumulations of sheets along a horizontal deck. An insert feeder is positioned above the horizontal deck. This feeder feeds the inserts that are to be placed underneath the accumulations transported by the chassis. Immediately downstream of the insert feeder, a set of driven accumulator nip rollers is positioned in line with the transport chassis. The driven accumulator nip rollers are positioned receive accumulations of sheets transported on the horizontal deck, and they are also positioned close enough to the insert feeder to receive inserts fed from the insert feeder.

A recessed accumulation deck is positioned immediately downstream of the accumulator nip rollers. The recessed accumulation deck is positioned below a level of the transport chassis horizontal deck and receives sheets from both the transport chassis and the insert feeder via the accumulator nips. If a first sheet rests in the recessed accumulation deck, a subsequent second sheet will be placed on top of the first sheet when it enters the recessed deck.

A controller controls motion of the transport chassis and the insert feeder. The controller is configured to control operation of the accumulator apparatus whereby one or more insert sheets are released by the insert feeder prior to arrival of an accumulation at that location on the chassis. The released insert is driven by the accumulator nip rollers onto the recessed accumulator deck prior. Then when the accumulation arrives, it is deposited on top of the insert already residing there.

In a further embodiment, an air pressure device, positioned at an upstream end of the recessed accumulation deck, uses air pressure to position sheets in the recessed deck. Also, the recessed deck is preferably comprised of a sloped plate that is lowest at its upstream end and that raises to a level of the horizontal deck at the downstream end. In a preferred embodiment, a movable stop at the downstream end of recessed deck, closes and opens during accumulation and release of sheets.

Further details of the present invention are provided in the accompanying drawings, detailed description and claims.

DETAILED DESCRIPTION

Figure 1:
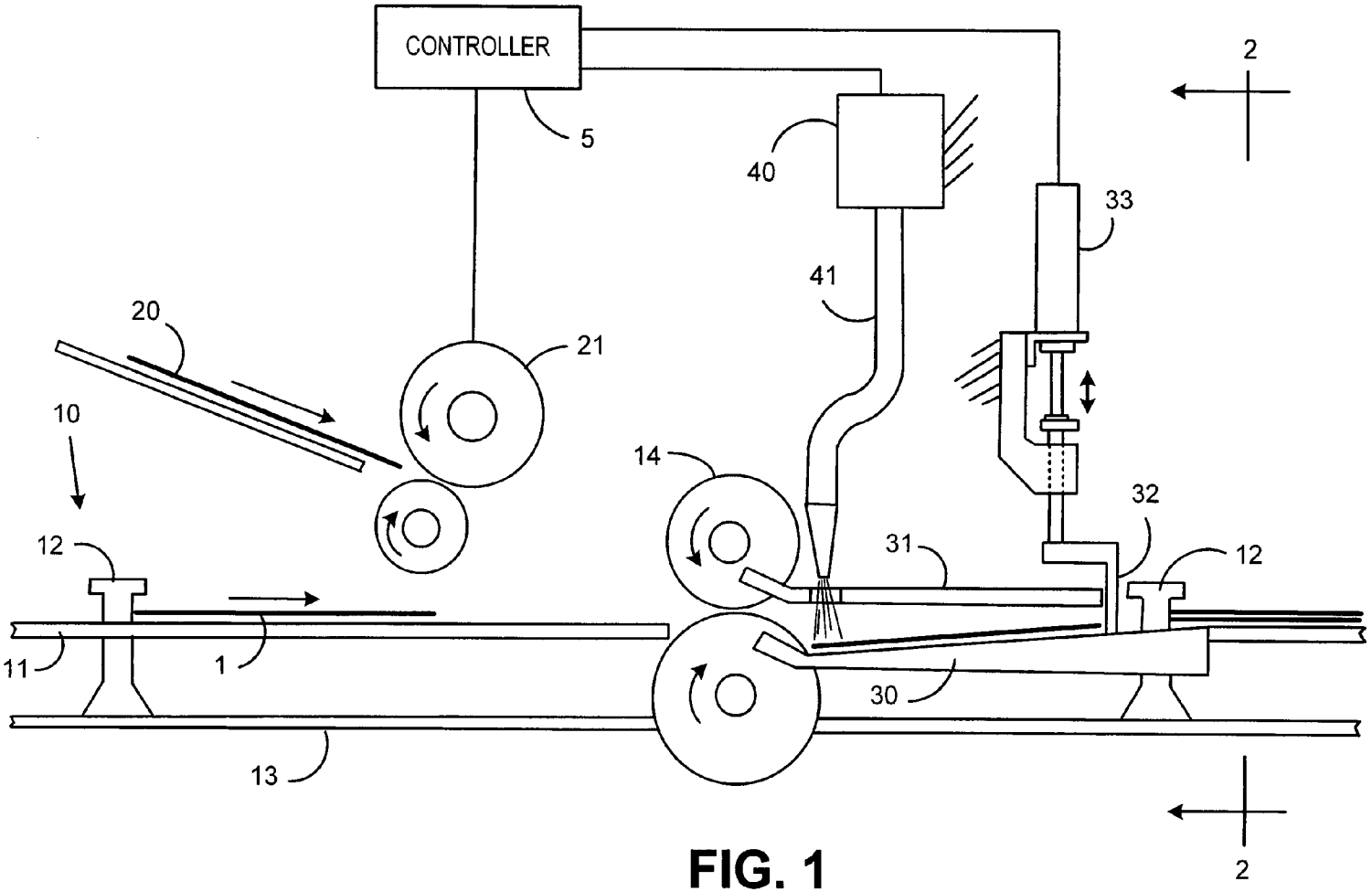
FIG. 1 is a side view of the improved accumulator described herein.

FIG. 1 depicts the components and operation of the improved accumulator. Sheet 1 is pushed along a horizontal chassis deck 11 from left to right. Sheet 1 might also be an accumulation of sheets including inserts that were added to the accumulation at an upstream location. Sheet 1 is pushed by pusher fingers 12 that extend through slots running along the length of the chassis deck 11. Pusher fingers 12 are, in turn, connected to a continuous belt 13 that are driven to move the pusher fingers 12 along the chassis.

Above the deck 11, an insert 20 rests in an insert feeder 21. Insert feeder 21 includes feed nips to feed inserts 20 to the horizontal deck 11 below. Downstream of the insert feeder 21, preferably within one insert 21 length, driven accumulator nip 14 is positioned in line with the horizontal deck 11 to receive both inserts 20, from above, and sheets 1, from the horizontal deck 11.

Immediately downstream of the driven accumulator nip 14, a recessed deck 30 is positioned to receive sheets. Preferably a stop 32 is in a stopping position to keep sheets in the recessed deck while they are being accumulated. Preferably the recessed deck is inclined at an angle of less than 25 degrees, with the lower end immediately downstream of nip 14. A guide 31 above the recessed deck also helps keep the accumulating sheets in place. Further an air blower 41, having an air pressure source 40, can provide an air pressure burst to help a tail end of the sheets clear the nip 14 in the recessed deck 30.

When a pusher finger 12 has pushed sheet 1 into the recessed deck 30 the accumulation is complete, and an actuator 33 causes stop 32 to open and the finger 12 pushes the completed collation out of the recessed deck 30 area.

Figure 2:
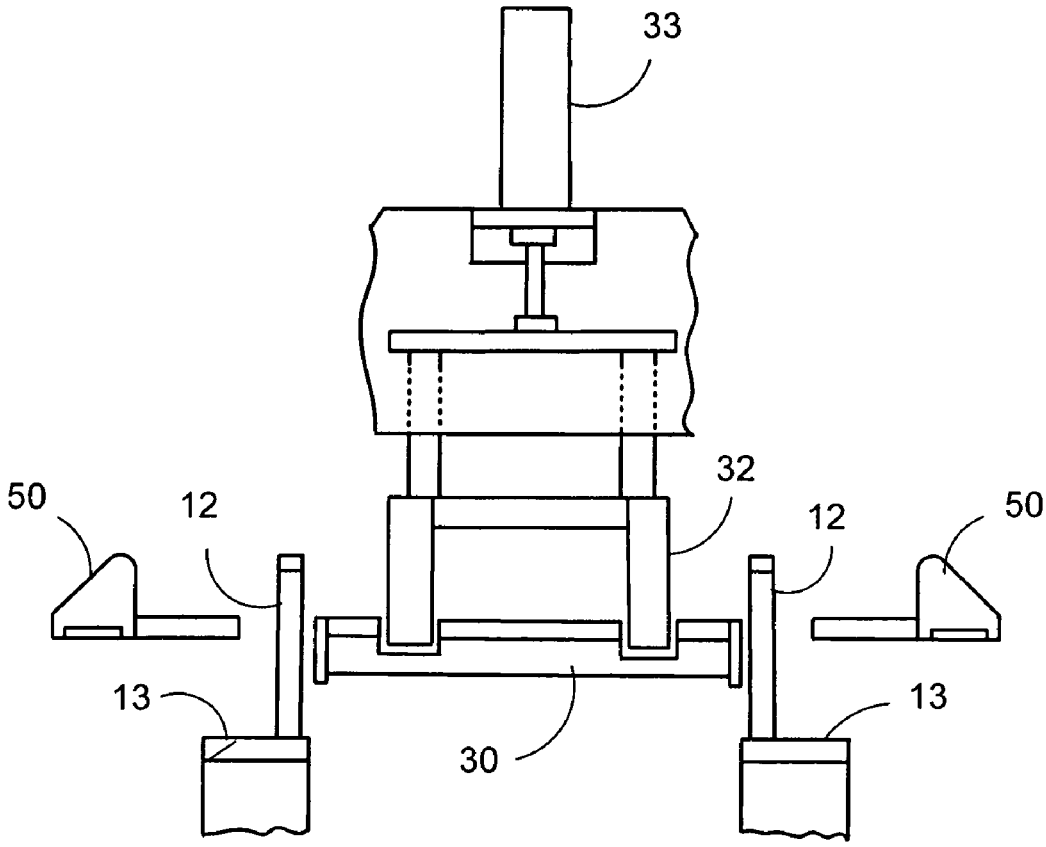
FIG. 2 depicts an end view 2-2 of the accumulator shown in FIG. 1.

FIG. 2 depicts an end-view of the stop arrangement 32 in relationship to a downstream end of guide deck 30. Actuator 33 acts to move the dual stop 32 arrangement up and down. Guides 50 serve to guide the edge of the sheets 1 as they are pushed through the apparatus by pusher fingers 12.

Figure 3A:
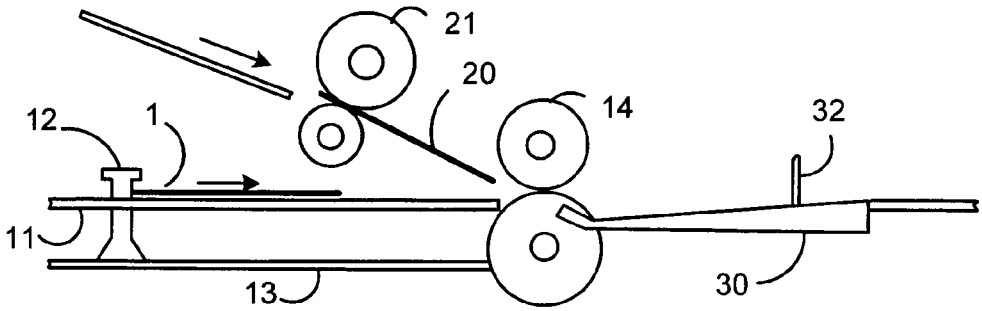
FIGS. 3A-3D show a sequence of how sheets are accumulated in the improved accumulator.
Figure 3B:
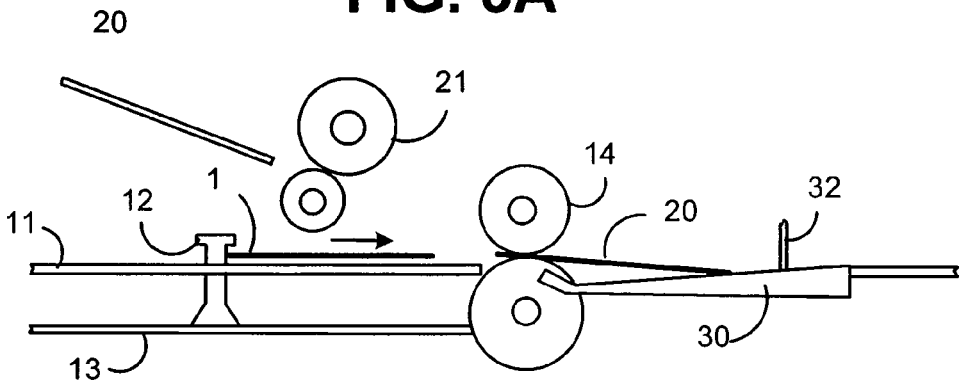
Figure 3C:
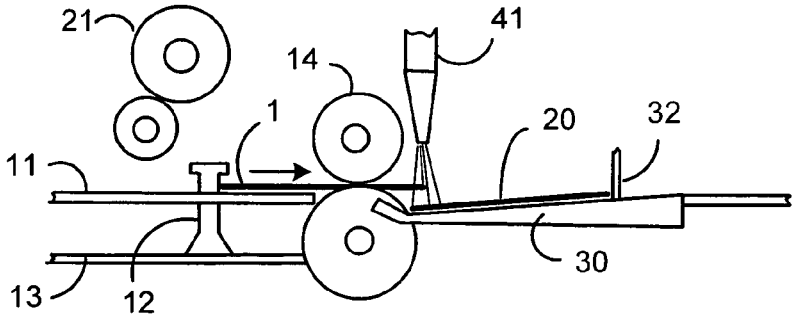
Figure 3D:
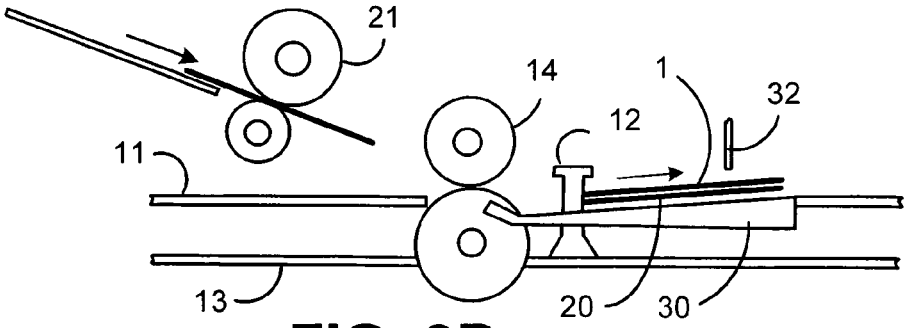

A controller 5 controls the operation of the insert feeder 21, the stop actuator 33, and the air source 41 to achieve the operation that is functionally depicted in the sequence of FIGS. 3A-3D. In FIG. 3A we can see the insert 20 being fed to the nip 14 in advance of the arrival of the sheet 1, pushed by fingers 12. In FIG. 3B, insert 20 is entering the recessed deck 30 region. In FIG. 3C, the stop 32 is acting to stop the forward motion of insert 20, and air source 41 is securing the tail end of insert 20 downward into the recessed deck 30. Finally in FIG. 3D, the sheet 1 is accumulated on top of insert 20 and the stop 32 rises so that the completed accumulation can be pushed out by fingers 12.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. An accumulator apparatus for an inserter system, the apparatus comprising:

a transport chassis comprising a horizontal deck and a series of pusher fingers arranged on a transport belt to push accumulations of sheets along a length of the horizontal deck;

an insert feeder positioned above the horizontal deck of the transport chassis for providing inserts to be included in accumulations of sheets on the transport chassis;

a set of driven accumulator nip rollers immediately downstream of the insert feeder, the set of driven accumulator nip rollers positioned in line with the transport chassis to receive accumulations of sheets transported on the horizontal deck, and positioned within one insert length downstream of the insert feeder to receive and transport inserts fed from the insert feeder;

a recessed accumulation deck immediately downstream of the accumulator nip rollers, the recessed accumulation deck positioned below a level of the transport chassis horizontal deck, the recessed deck receiving sheets from both the transport chassis and the insert feeder via the accumulator nips, and whereby a first sheet will rest in the recessed accumulation deck and a subsequent second sheet will be placed on top of the first sheet; and a controller coupled to the transport chassis and the insert feeder, whereby the controller is configured to control operation of the accumulator apparatus whereby one or more insert sheets are released by the insert feeder to be driven by the accumulator nip rollers onto the recessed accumulator deck prior to arrival of one or more accumulation sheets pushed by the pusher fingers on the horizontal deck at the accumulator roller nips.

2. The accumulator apparatus of claim 1 further comprising an air pressure device positioned at an upstream end of the recessed accumulation deck and arranged to apply air pressure to sheets in the recessed accumulation deck to keep the accumulator roller nips clear.

3. The accumulator apparatus of claim 1 wherein the recessed accumulation deck comprises a sloped plate that is lowest at its upstream end and that raises to a level of the horizontal deck at the downstream end.

4. The accumulator apparatus of claim 3 wherein an angle of the sloped plate is less than 25 degrees.

5. The accumulator apparatus of claim 1 wherein the controller is arranged to control the insert feeder to operate intermittently to feed insert sheets into gaps between the pusher fingers on the transport chassis.

6. The accumulator apparatus of claim 1 further comprising a movable stop at downstream end of recessed deck, the movable stop configured with a first stopping position to contain sheets on the recessed deck and with a second open position for releasing sheets from the recessed deck.

7. A method for accumulating sheets comprising:

transporting one or more primary sheets along a length of a horizontal deck;

feeding one or more inserts to be combined with the one or more primary sheets from an insert feeding location above the horizontal deck;

positively driving the one or more primary sheets on the horizontal deck and the one or more inserts at a driving location immediately downstream from the insert feeding location;

receiving the positively driven sheets and inserts on a recessed accumulation deck immediately downstream of the driving location, the recessed accumulation deck being positioned below a level of the horizontal deck, and whereby a first set of one or more inserts will rest in the recessed accumulation deck and a subsequent second set of one or more primary sheets will be placed on top of the first set;

wherein the step of feeding one or more insert sheets is controlled to cause the one or more insert sheets to be received on the recessed deck prior to the one or more primary sheets from the horizontal deck; and pushing a combined accumulation of the driven sheets and the insert sheets out of a downstream end of the recessed accumulation deck.

8. The method of claim 7 further comprising a step of applying air pressure at an upstream end of the recessed accumulation deck thereby applying air pressure to sheets in the recessed accumulation deck.

9. The method of claim 7 further including steps of blocking a downstream end of the recessed accumulation deck with a movable stop at downstream end of recessed deck during the receiving step, and opening the movable stop during the step of pushing the combined accumulation out of the recessed deck.

* * * * *